US011600424B2

(12) United States Patent
Yoshida

(10) Patent No.: US 11,600,424 B2
(45) Date of Patent: Mar. 7, 2023

(54) CORE MAIN BODY, REACTOR, AND METHOD OF MANUFACTURING REACTOR

(71) Applicant: Fanuc Corporation, Yamanashi (JP)

(72) Inventor: Tomokazu Yoshida, Yamanashi (JP)

(73) Assignee: Fanuc Corporation, Yamanashi (JP)

( * ) Notice: Subject to any disclaimer, the term of this patent is extended or adjusted under 35 U.S.C. 154(b) by 347 days.

(21) Appl. No.: 16/908,889

(22) Filed: Jun. 23, 2020

(65) Prior Publication Data

US 2021/0005375 A1 Jan. 7, 2021

(30) Foreign Application Priority Data

Jul. 3, 2019 (JP) ..... JP2019-124505

(51) Int. Cl.
*H01F 27/24* (2006.01)
*H01F 41/02* (2006.01)
*H01F 27/28* (2006.01)

(52) U.S. Cl.
CPC ..... *H01F 27/24* (2013.01); *H01F 27/28* (2013.01); *H01F 41/0206* (2013.01)

(58) Field of Classification Search
CPC ..... H01F 27/24; H01F 27/28; H01F 41/0206; H01F 3/14; H01F 27/263; H01F 27/306; H01F 37/00; H01F 27/002; H01F 27/245; H01F 41/0233; H01F 41/04
See application file for complete search history.

(56) References Cited

U.S. PATENT DOCUMENTS

2009/0261939 A1* 10/2009 Shudarek ..... H01F 27/263 336/212
2014/0077916 A1* 3/2014 Eom ..... H01F 27/325 336/198
2019/0013136 A1* 1/2019 Tsukada ..... H01F 27/38

FOREIGN PATENT DOCUMENTS

JP 2019029449 A 2/2019

* cited by examiner

*Primary Examiner* — Lincoln D Donovan
*Assistant Examiner* — Alex W Lam
(74) *Attorney, Agent, or Firm* — RatnerPrestia

(57) ABSTRACT

A core main body includes an outer peripheral iron core, and at least three iron cores. Between the two iron cores adjacent to each other, a gap being magnetically couplable is formed. The outer peripheral iron core includes a first outer peripheral iron core block and a second outer peripheral iron core block that are formed by stacking a plurality of magnetic plates, and an intermediate plate disposed therebetween. The intermediate plate includes an outer peripheral iron core corresponding portion corresponding to the outer peripheral iron core, a plurality of protruding sections protruding from an outer peripheral surface of the outer peripheral iron core, and engaging sections provided on the plurality of protruding sections.

7 Claims, 8 Drawing Sheets

CORE MAIN BODY, REACTOR, AND METHOD OF MANUFACTURING REACTOR

CROSS-REFERENCE TO RELATED APPLICATIONS

This application is a new U.S. Patent Application that claims benefit of Japanese Patent Application No. 2019-124505, dated Jul. 3, 2019, the disclosure of this application is being incorporated herein by reference in its entirety for all purposes.

BACKGROUND OF THE INVENTION

1. Field of the Invention

The present invention relates to a core main body, a reactor, and a method of manufacturing the reactor.

2. Description of the Related Art

In recent years, a reactor has been developed that is provided with a core main body including an outer peripheral iron core and a plurality of iron cores disposed inside the outer peripheral iron core. Each of the plurality of iron cores is mounted with a coil. The core main body of such a reactor is sandwiched between an end plate and a pedestal. For example, see Japanese Unexamined Patent Publication No. 2019-029449 A.

SUMMARY OF THE INVENTION

In general, a reactor is attached on a vertical surface, for example, a wall section of a power distribution board. In such a case, by inserting a wire or the like into an opening formed on a corner section of the end plate, the reactor is lifted up and transported to a desired location, and then a pedestal of the reactor is attached on the vertical surface.

However, because the end plate is attached to one end of a core main body, the end plate is positioned away from a center of gravity of the reactor. For this reason, there has been a problem that when the reactor is lifted up, the reactor is inclined, and as a result, workability is lowered during transport and during attachment on the vertical surface. In addition, in a case where only the core main body to which the end plate is attached is lifted up, the core main body is also inclined, so a similar problem occurs.

Therefore, a core main body and a reactor that do not lower workability during transport and attachment, and a manufacturing method of such a reactor are desired.

According to a first aspect of the present disclosure, there is provided a core main body including an outer peripheral iron core and at least three iron cores disposed inside the outer peripheral iron core, wherein a radial inner end portion of each of the at least three iron cores converges toward a center of the outer peripheral iron core, each of the gaps being magnetically couplable, is formed between one iron core of the at least three iron cores and another iron core adjacent to the one iron core, the radial inner end portions of the at least three iron cores are spaced apart from each other through the gaps being magnetically couplable, the outer peripheral iron core is configured with at least a first outer peripheral iron core block formed by stacking a plurality of magnetic plates, a second outer peripheral iron core block formed by stacking a plurality of magnetic plates, and an intermediate plate disposed between the first outer peripheral iron core block and the second outer peripheral iron core block, and the intermediate plate includes an outer peripheral iron core corresponding portion corresponding to the outer peripheral iron core, a plurality of protruding sections protruding from an outer peripheral surface of the outer peripheral iron core, and engaging sections provided on the plurality of protruding sections.

In the first aspect, since the intermediate plate is disposed between the first outer peripheral iron core block and the second outer peripheral iron core block, the engaging sections of the intermediate plate are adjacent to a center of gravity of the core main body. Thus, when the reactor including the core main body is lifted up by using the engaging sections, the reactor is hardly inclined. Therefore, workability during transport and attachment is not lowered.

The objects, features and advantages of the present invention will become more apparent from the description of the following embodiments in connection with the accompanying drawings.

DETAILED DESCRIPTION

Figure 1A:
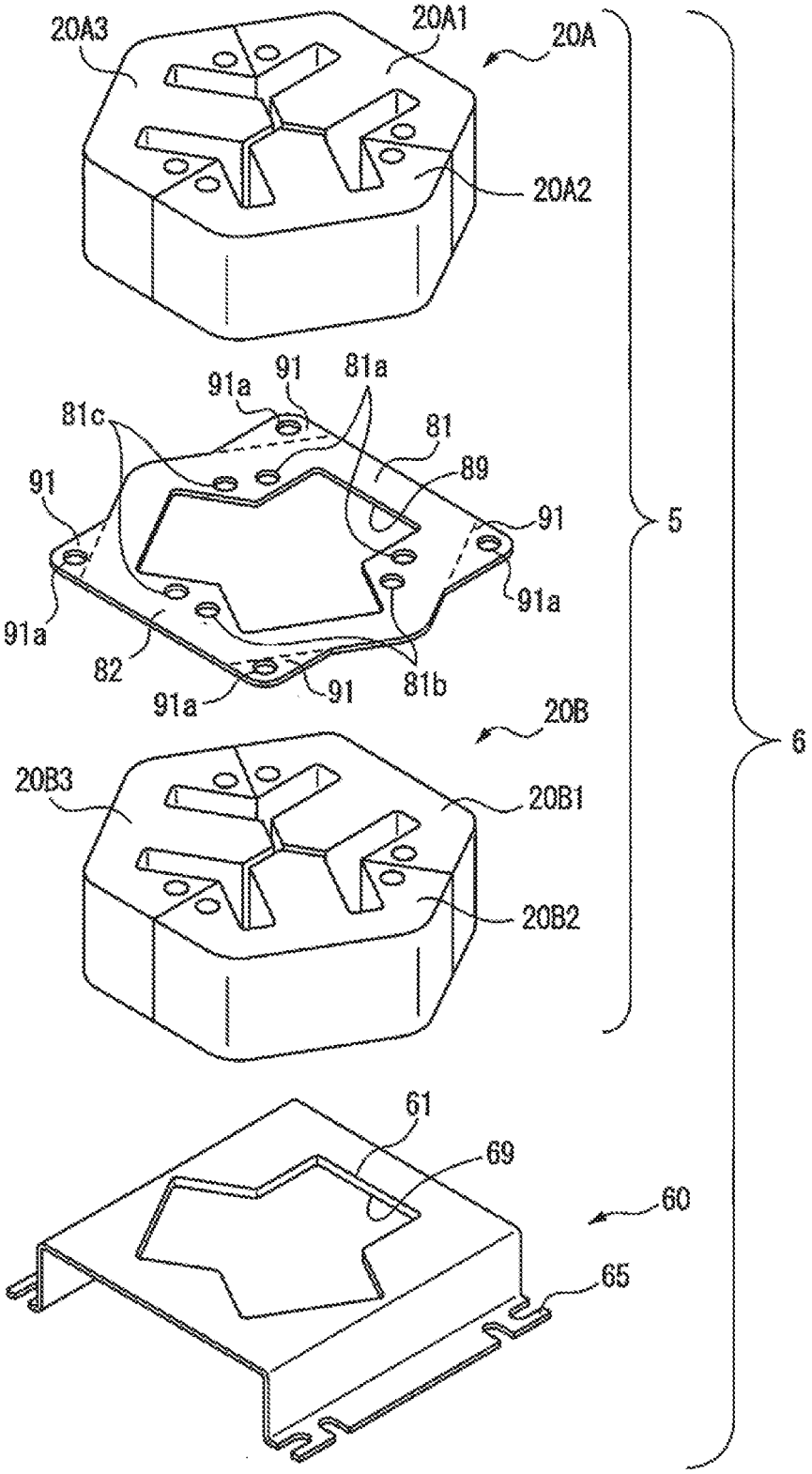
FIG. 1A is an exploded perspective view of a reactor according to a first embodiment.

Embodiments of the present invention will be described below with reference to the accompanying drawings. Throughout the drawings, corresponding components are denoted by common reference numerals.

While in the following description, a three-phase reactor is primarily described by way of an example, an application of the present disclosure is not limited to the three-phase reactor and the present disclosure is widely applicable to a multi-phase reactor in which a constant inductance is required for each phase. In addition, the reactor according to the present disclosure is not limited to that provided on a primary side and a secondary side of an inverter in an industrial robot or a machine tool and can be applied to various apparatuses.

Figure 1B:
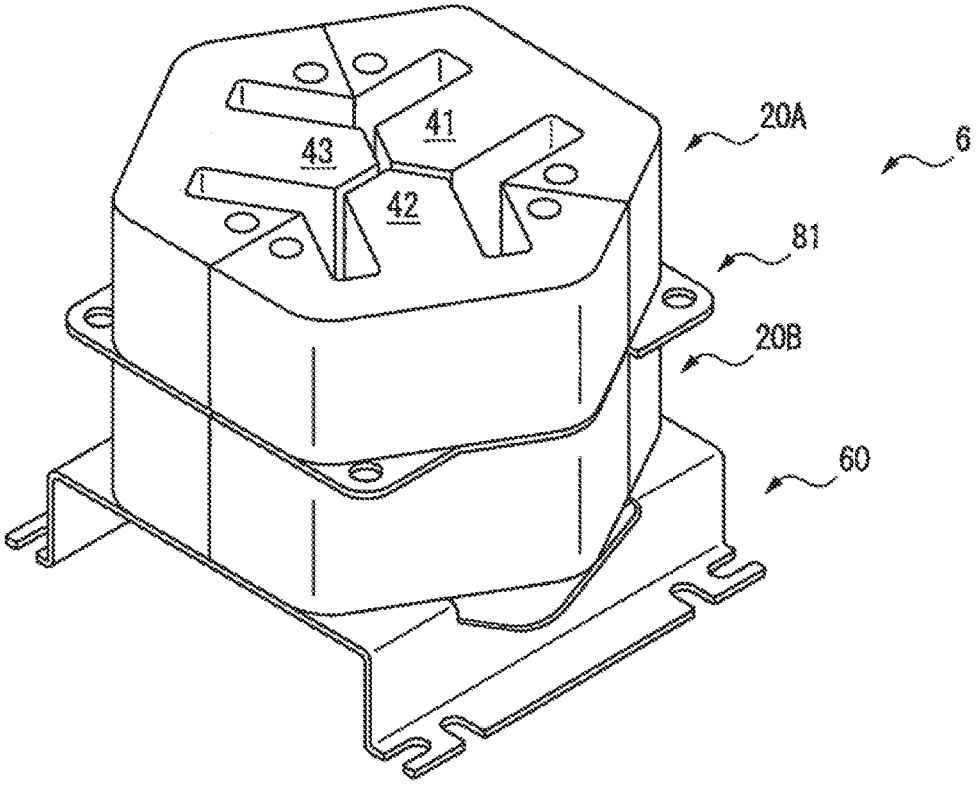
FIG. 1B is a perspective view of the reactor illustrated in FIG. 1A.

FIG. 1A is an exploded perspective view of the reactor according to the first embodiment, and FIG. 1B is a perspective view of the reactor illustrated in FIG. 1A. A reactor 6 illustrated in FIG. 1A and FIG. 1B mainly includes a core main body 5 and a pedestal 60 attached to one end of the core main body 5.

The core main body 5 includes a first outer peripheral iron core block 20A, a second outer peripheral iron core block 20B, and an intermediate plate 81 sandwiched between the first outer peripheral iron core block 20A and the second outer peripheral iron core block 20B. Each of the first outer peripheral iron core block 20A and the second outer peripheral iron core block 20B is formed by stacking a plurality of magnetic plates, for example, an iron plate, a carbon steel plate, and an electromagnetic steel plate in an axial direction of the reactor 6. The magnetic plates used to form the first outer peripheral iron core block 20A and the magnetic plates used to form the second outer peripheral iron core block 20B are the same as each other. Furthermore, the number of stacked magnetic plates may be the same as or different from each other in the first outer peripheral iron core block 20A and the second outer peripheral iron core block 20B. When the first outer peripheral iron core block 20A, the intermediate plate 81, and the second outer peripheral iron core block 20B are assembled in the axial direction, an outer peripheral iron core 20 is formed.

The intermediate plate 81 includes an outer peripheral iron core corresponding portion 82 corresponding to the outer peripheral iron core 20, a plurality of protruding sections 91 protruding from an outer peripheral surface of the outer peripheral iron core 20, and engaging sections 91*a* provided on the plurality of protruding sections. An opening 89 formed in the intermediate plate 81 has a shape generally corresponding to an inner peripheral surface of the outer peripheral iron core 20. The intermediate plate 81 is preferably formed from a non-magnetic material.

The pedestal 60 contacts the outer peripheral iron core 20 across the entire edge of an end face of the outer peripheral iron core 20 of the core main body 5. The pedestal 60 is preferably formed from a non-magnetic material, for example, aluminum, SUS, resin, or the like. An opening 69 having an outer shape suitable for mounting the end face of the core main body 5 is formed in the pedestal 60. The opening 69 formed in the pedestal 60 and the opening 89 formed in the intermediate plate 81 are sufficiently large for coils 51 to 53 (to be described below) to protrude from the end face of the core main body 5. Additionally, a height of the pedestal 60 is slightly longer than a protruding height of each of the coils 51 to 53 protruding from an end portion of the core main body 5. A notch 65 formed on a bottom face of the pedestal 60 is used to secure the reactor 6 provided on the pedestal 60 to a predetermined location.

Figure 2:
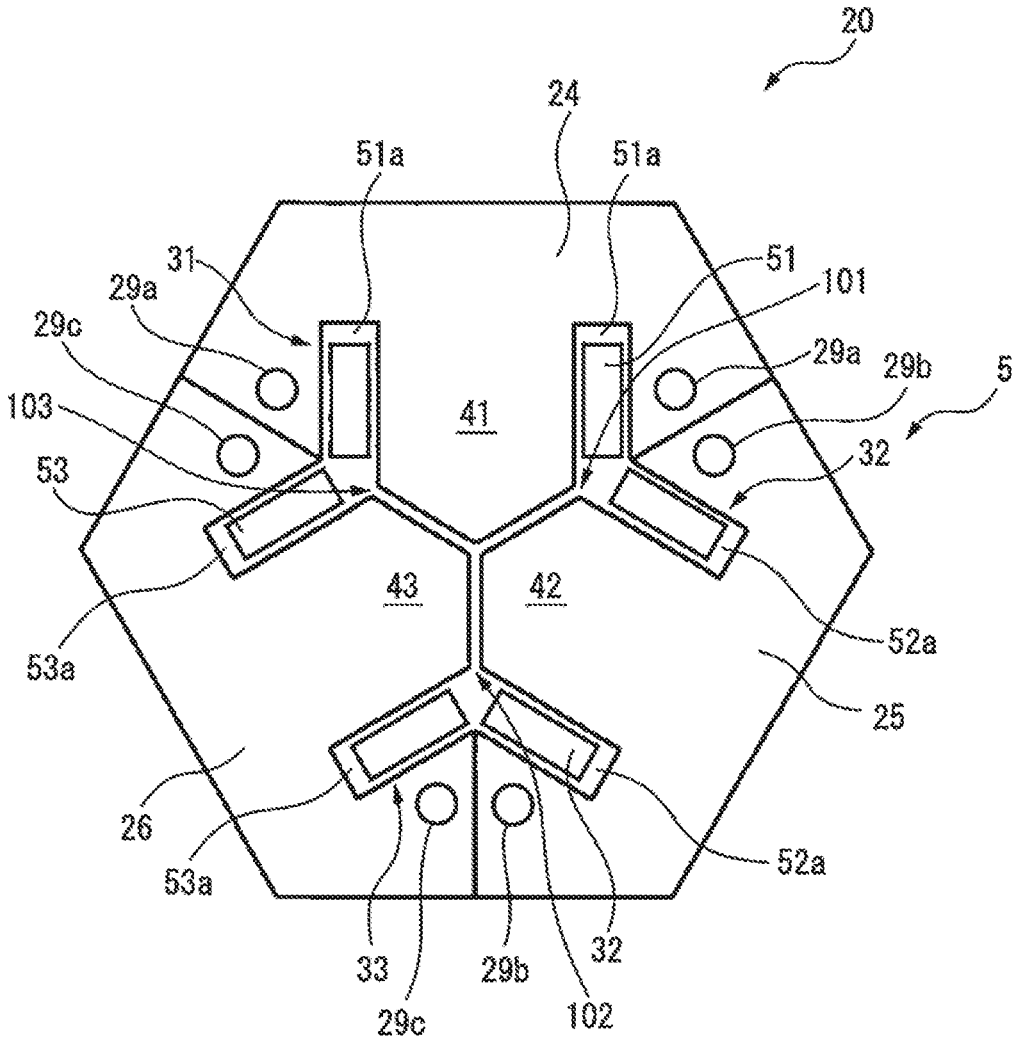
FIG. 2 is a cross-sectional view of a core main body included in the reactor according to the first embodiment.

FIG. 2 is a cross-sectional view of a core main body included in the reactor according to the first embodiment. As illustrated in FIG. 2, the core main body 5 includes the outer peripheral iron core 20 and three iron core coils 31 to 33 magnetically mutually coupling the outer peripheral iron core 20. In FIG. 2, the iron core coils 31 to 33 are disposed inside the outer peripheral iron core 20 whose cross section is a substantially hexagonal shape. These iron core coils 31 to 33 are arranged at equal intervals in a circumferential direction of the core main body 5. Note that the outer periphery iron core 20 may be a circular shape or other substantially regular even polygons. Additionally, the number of iron core coils may be preferably a multiple of three, and in that case, the reactor 6 can be used as a three-phase reactor.

As can be seen from the drawing, the iron core coils 31 to 33 respectively include iron cores 41 to 43 extending only in a radial direction of the outer peripheral iron core 20, and the coils 51 to 53 mounted around the corresponding iron cores. A radial outside end portion of each of the iron cores 41 to 43 is formed in contact with the outer peripheral iron core 20 or is formed integrally with the outer peripheral iron core 20. In other words, the iron cores 41 to 43 may be a separate member from the outer peripheral iron core 20. Note that in some drawings, illustration of the coils 51 to 53 is eliminated for the sake of simplicity.

Additionally, in FIG. 2, the outer peripheral iron core 20 is configured with a plurality of outer peripheral iron core portions, for example, three outer peripheral iron core portions 24 to 26 divided at equal intervals in a circumferential direction. The outer peripheral iron core portions 24 to 26 are formed integrally with the iron cores 41 to 43, respectively. Forming the outer peripheral iron core 20 with the plurality of outer peripheral iron core portions 24 to 26 as described above enables, even when the outer peripheral iron core 20 is large, the outer peripheral iron core 20 described above to be easily manufactured. In addition, through-holes 29*a* to 29*c* are formed in the outer peripheral iron core portions 24 to 26, respectively.

In such cases, as illustrated in FIG. 1A, the first outer peripheral iron core block 20A is configured with a plurality of, for example, three outer peripheral iron core portion blocks 20A1 to 20A3. Similarly, the second outer peripheral iron core block 20B is configured with a plurality of, for example, three outer peripheral iron core portion blocks 20B1 to 20B3. Each of the outer peripheral iron core portion blocks 20A1 to 20A3, and 20B1 to 20B3 is formed by stacking a plurality of magnetic plates, for example, an iron plate, a carbon steel plate, and an electromagnetic steel plate. Note that only one of the first outer peripheral iron core block 20A and the second outer peripheral iron core block 20B may be configured with a plurality of outer peripheral iron core portion blocks.

In addition, a radial inner end portion of each of the iron cores 41 to 43 is positioned near a center of the outer peripheral iron core 20. In the drawing, the radial inner end portion of each of the iron cores 41 to 43 converges toward the center of the outer peripheral iron core 20 and has a tip angle of about 120 degrees. Additionally, the radial inner end portions of the iron cores 41 to 43 are spaced apart from each other with gaps 101 to 103 being magnetically couplable.

In other words, the radial inner end portion of the iron core 41 is spaced apart from the radial inner end portions of the respective two adjacent iron cores 42 and 43 with the gaps 101 and 102. The same applies to the other iron cores 42 and 43. Note that the gaps 101 to 103 are equal to each other in dimensions.

As described above, in the present invention, a central part iron core to be positioned at a central part of the core main body 5 is not required, so the core main body 5 can be reduced in weight and formed with a simple configuration. In addition, the three iron core coils 31 to 33 are surrounded by the outer peripheral iron core 20, so magnetic fields generated from the coils 51 to 53 do not leak from the outer peripheral iron core 20 to the outside. Also, the gaps 101 to 103 can be provided at any thickness and at a low cost, so it is advantageous in design compared to reactors with configurations in the related art.

In addition, the reactor 6 of the present invention has a difference in magnetic path length between phases that is less than that in reactors with configurations in the related art. Thus, the present invention enables reducing unbalance in inductance due to the difference in magnetic path length.

Referring to FIGS. 1A and 1B, the intermediate plate 81 includes the plurality of protruding sections 91 that partially protrude in a direction away from the outer peripheral surface of the core main body 5. In other words, the protruding sections 91 extend radially outward with respect to a central axis of the core main body 5. An opening 91*a* as an engaging section is formed in each of the protruding sections 91. In addition, through-holes 81*a* to 81*c* are formed in the intermediate plate 81, corresponding to the through-holes 29*a* to 29*c* of the outer peripheral iron core 20.

Figure 3:
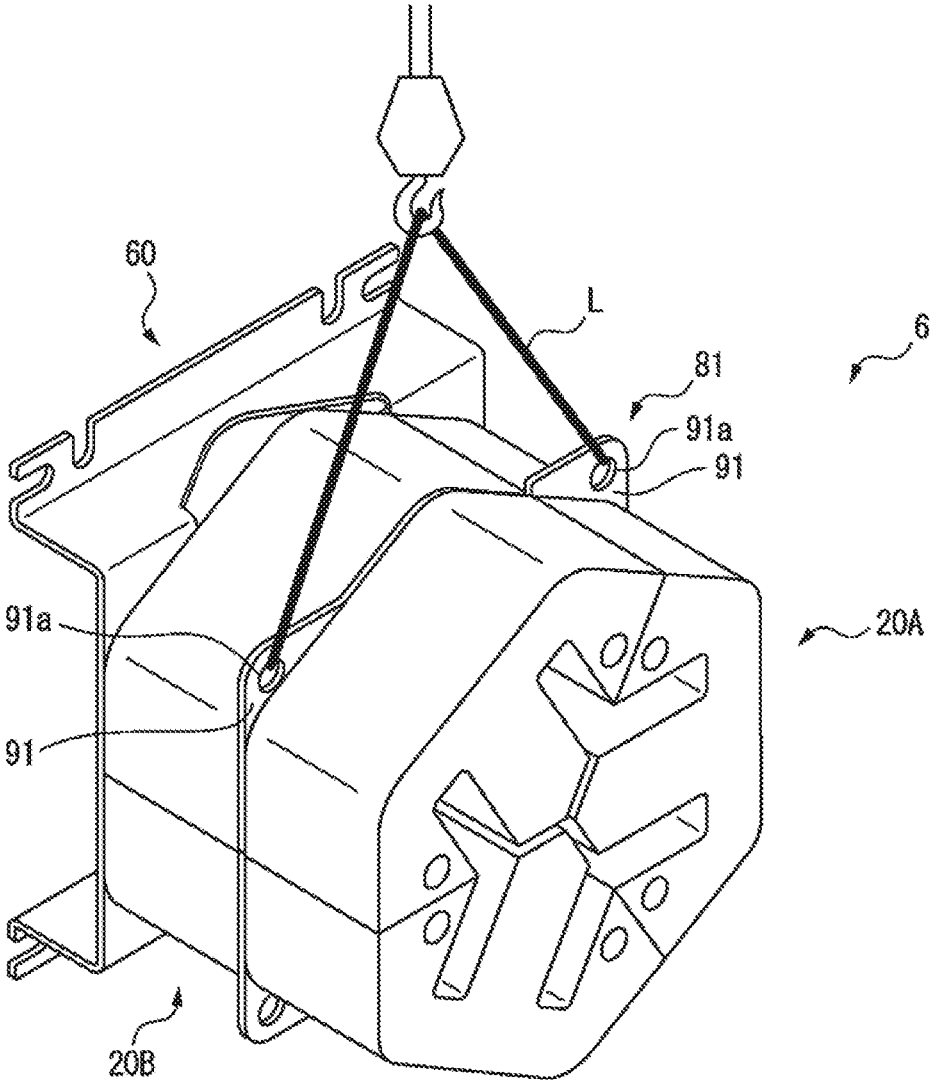
FIG. 3 is another perspective view of the reactor according to the first embodiment.

The protruding section 91 protrudes corresponding to at least one side of a substantially regular even polygon, for example, a substantially hexagonal shape. FIG. 3 is a perspective view of the reactor according to the first embodiment. As illustrated in FIG. 3, an umbilical member L such as a wire is inserted into the engaging section 91*a* of the protruding section 91 to lift up the reactor 6. In order to stably lift up the reactor 6, the intermediate plate 81 preferably includes at least two engaging sections 91*a* adjacent to each other.

In the present invention, the intermediate plate 81 is disposed between the first outer peripheral iron core block 20A and the second outer peripheral iron core block 20B, and thus the engaging sections 91*a* of the intermediate plate 81 are adjacent to the center of gravity of the core main body 5. Thus, when the reactor 6 is lifted up by using the engaging sections 91*a*, the reactor 6 is hardly inclined. Thus, workability is not lowered when the reactor 6 is transported and when the reactor 6 is attached to a desired location, for example, a vertical plane. For this purpose, a position of the opening 91*a* in the axial direction of the core main body 5 is preferably equal to the center of gravity of the core main body 5 or the reactor 6 in the axial direction.

Note that it is also possible to avoid lowering in workability even when only the core main body 5 is lifted up, transported, or attached. Also, the protruding section 91 may be partially curved with respect to an end face of the first outer peripheral iron core block 20A. Furthermore, instead of the openings 91*a*, other configurations that can engage the umbilical member L can be used as the engaging section, for example, a hook section, a convex section, or the like.

Figure 4:
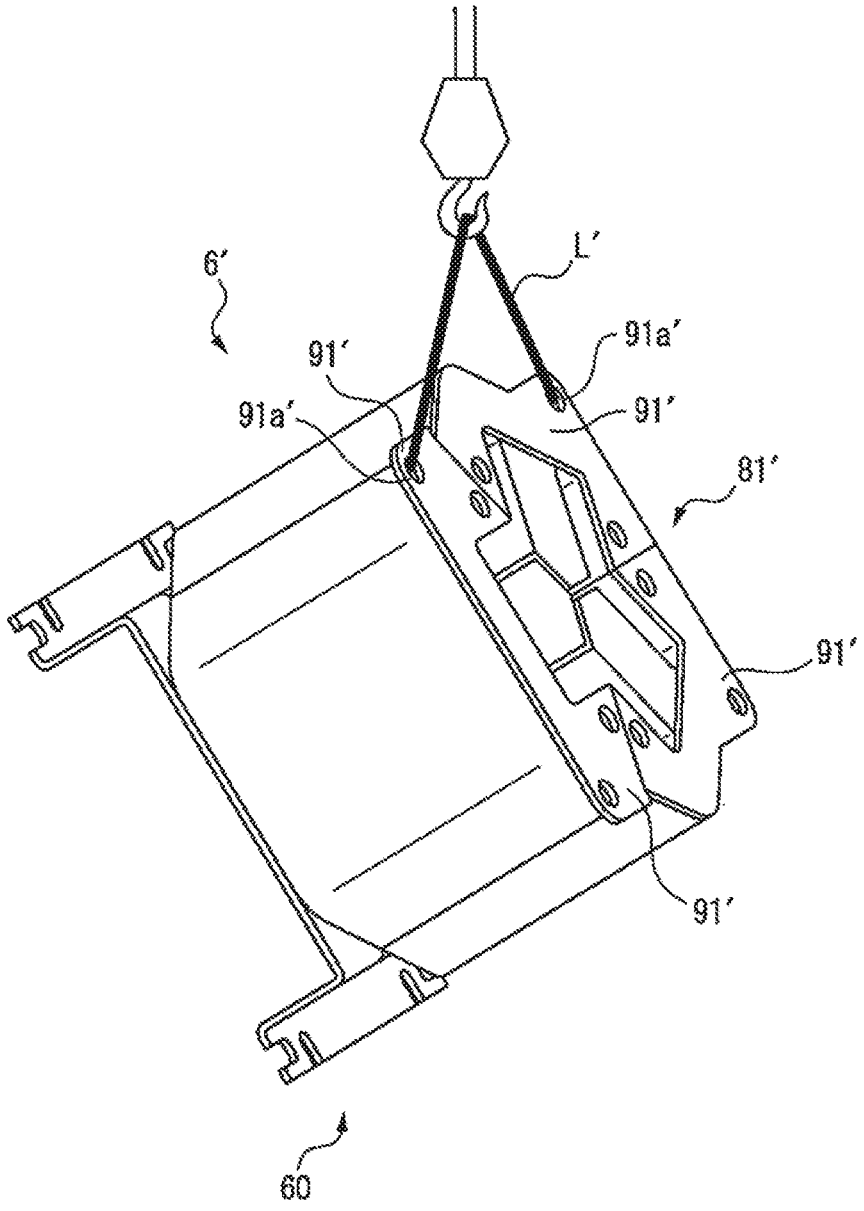
FIG. 4 is a perspective view of a reactor of the related art.

FIG. 4 is a perspective view of a reactor of the related art. In the related art, an end plate 81' having protruding sections 91' is attached to an end portion of the reactor 6'. Since a position of the end plate 81' is located away from a center of gravity of the reactor 6', lifting the reactor 6' by passing the umbilical member L through an opening 91*a'* raises a problem that the reactor 6' is inclined. The present invention solves this problem.

Also, as can be seen in FIG. 1A, a footprint of the pedestal 60 is a rectangle, and the rectangle is a circumscribing rectangle circumscribing the outer periphery of the outer peripheral iron core 20. Accordingly, the footprint of the pedestal 60 is different from an outer peripheral shape of the core main body 5, for example, a substantially regular even polygon or a circular shape. In such cases, it is preferable that at least one protruding section 91 protrude within the footprint of the pedestal 60.

In such cases, the protruding section 91 only protrudes up to an outer edge of the pedestal. Thus, the footprint of the reactor 6 can be less than or equal to the footprint of the pedestal 60, and an increase in size of the reactor 6 can be avoided.

Figure 5A:
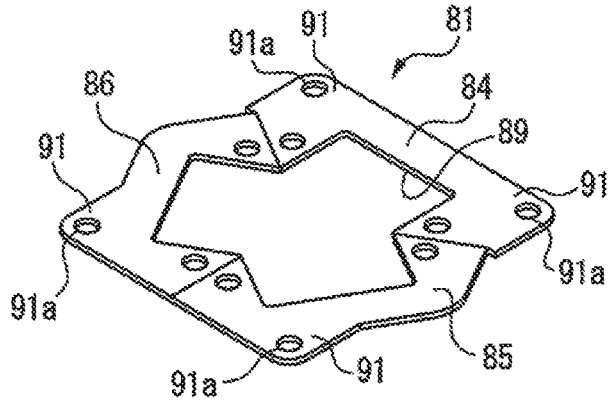
FIG. 5A is a perspective view of another intermediate plate.

FIG. 5A is a perspective view of another intermediate plate. The intermediate plate 81 illustrated in FIG. 5A is configured with a plurality of, for example, three intermediate plate portions 84, 85, and 86. These intermediate plate portions 84 to 86 respectively correspond to the outer peripheral iron core portions 24 to 26. In addition, each of the intermediate plate portions 84 to 86 includes at least one protruding section 91. In this manner, the intermediate plate 81 may be configured with a plurality of intermediate plate portions 84 to 86 and may be a single member as illustrated in FIG. 1A. In such a configuration, it can be understood that a large outer peripheral iron core 20 can be easily manufactured without lowering workability during transport and attachment.

Figure 5B:
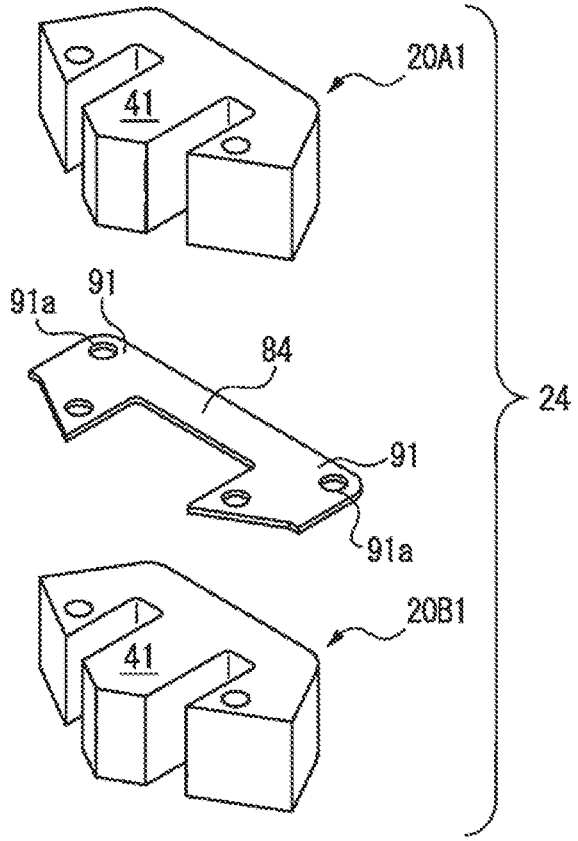
FIG. 5B is a first diagram illustrating a method of manufacturing a reactor.
Figure 5C:
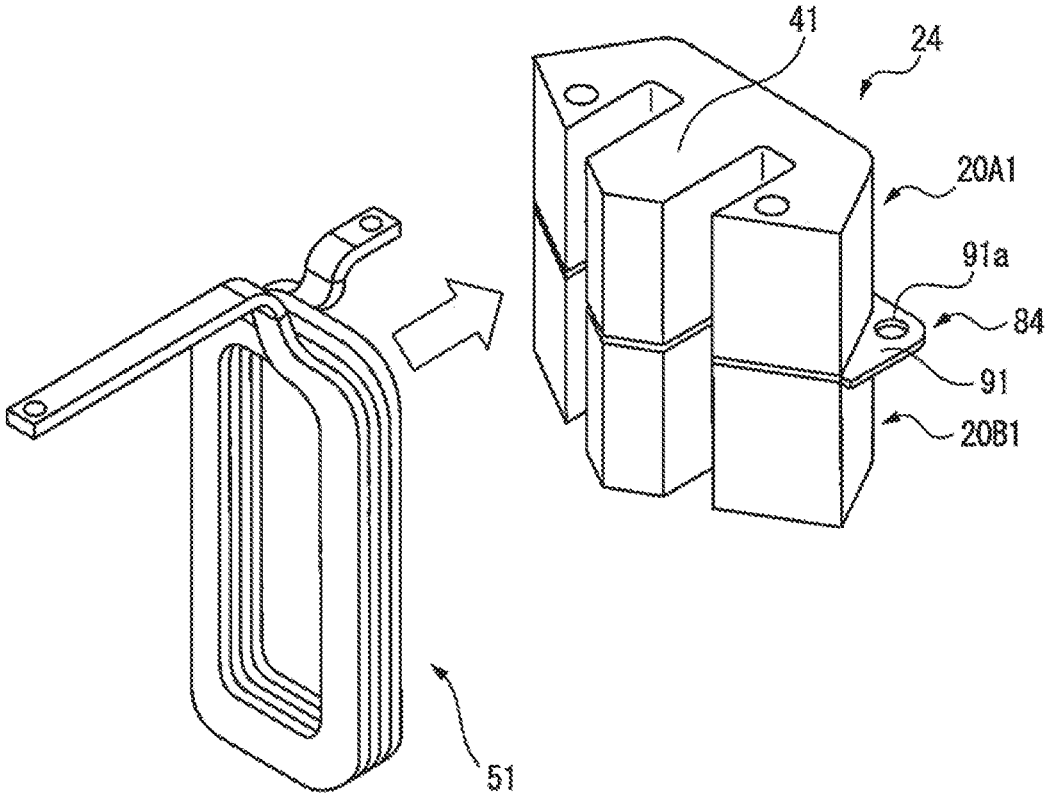
FIG. 5C is a second diagram illustrating a method of manufacturing a reactor.

FIGS. 5B and 5C are diagrams illustrating a method of manufacturing a reactor. As illustrated in FIG. 5B, after forming the outer peripheral iron core portion blocks 20A1 and 20B1, the intermediate plate portion 84 is sandwiched between the outer peripheral iron core portion blocks 20A1 and 20B1 to form the outer peripheral iron core portion 24. Although not illustrated in the drawings, the intermediate plate portions 85 and 86 are respectively sandwiched between the outer peripheral iron core portion blocks 20A2 and 20B2, and between the outer peripheral iron core portion blocks 20A3 and 20B3 to form the outer peripheral iron core portions 25 and 26.

Then, the iron core 41 of the outer peripheral iron core portion 24 is inserted into the coil 51 to mount the coil 51, as illustrated in FIG. 5C. Also, although not illustrated in the drawings, the coils 52 and 53 are also mounted to the iron core 42 of the outer peripheral iron core portion 25 and the iron core 43 of the outer peripheral iron core portion 26, respectively.

These outer peripheral iron core portions 24 to 26 are then assembled together. Then, screws or bolts (not illustrated) are inserted into the through-holes 29*a* to 29*c* of the outer peripheral iron core 20 and the through-holes 81*a* to 81*c* of the intermediate plate 81 and are tightened to create the core main body 5. Thereafter, the pedestal 60 is disposed on one end of the core main body 5 and is tightened in the similar manner with screws or bolts (not illustrated). As a result, the outer peripheral iron core 20 and the pedestal 60 are secured to each other to create the reactor 6. To this end, through-holes may be formed in the pedestal 60.

Figure 5D:
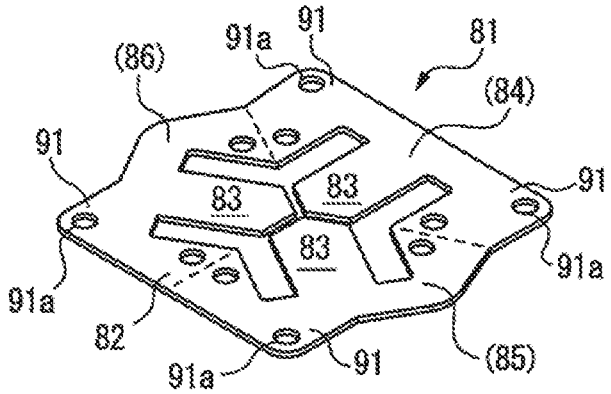
FIG. 5D is a perspective view of yet another intermediate plate.

Furthermore, FIG. 5D is a perspective view of yet another intermediate plate. The intermediate plate 81 illustrated in FIG. 5D includes, in addition to the outer peripheral iron core corresponding portion 82 and the protruding sections 91, iron core corresponding portions 83 corresponding to the iron cores 41 to 43. In this case, the intermediate plate 81 is preferably formed from the same magnetic plate as the outer peripheral iron core 20 and the iron cores 41 to 43. In addition, the intermediate plate 81 illustrated in FIG. 5D may be formed by stacking such a plurality of magnetic plates. In this case, a clearance is not formed between the first outer peripheral iron core block 20A and the second outer peripheral iron core block 20B. As a result, when the reactor 6 is driven, generation of noise due to vibration of the iron cores 41 to 43 is suppressed. Also, as illustrated by broken lines in FIG. 5D, the intermediate plate 81 may be configured with at least three intermediate plate portions 84 to 86 each of which includes the iron core corresponding portion 83.

Figure 6:
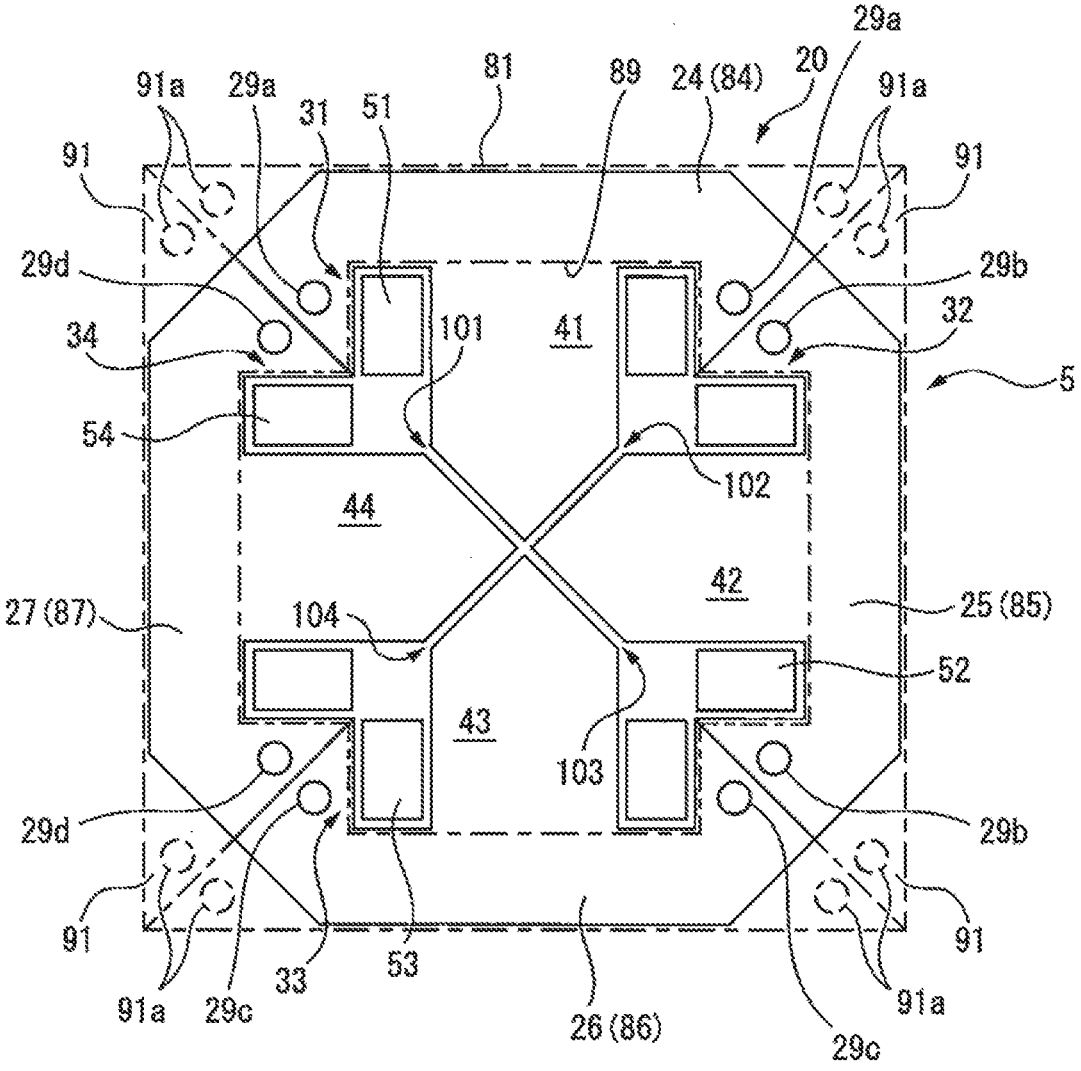
FIG. 6 is a cross-sectional view of a core main body included in a reactor according to a second embodiment.

FIG. 6 is a cross-sectional view of a core main body of a reactor according to a second embodiment. The core main body 5 illustrated in FIG. 6 includes the outer peripheral iron core 20 whose cross section is a substantially octagonal shape, and four iron core coils 31 to 34, similar to those described above, disposed inside the outer peripheral iron core 20. These iron core coils 31 to 34 are arranged at equal intervals in a circumferential direction of the core main body 5. In addition, the number of iron cores is preferably an even number being equal to or more than four, and thus the reactor provided with the core main body 5 can be used as a single-phase reactor.

As can be seen from the drawings, the outer peripheral iron core 20 is formed of four outer peripheral iron core portions 24 to 27 that are circumferentially disposed. The iron core coils 31 to 34 respectively include the iron cores 41 to 44 extending only radially and the coils 51 to 54 mounted around the corresponding iron cores. Additionally, each of the iron cores 41 to 44 has a radial outer end portion formed integrally with the corresponding outer peripheral iron core portions 24 to 27. In addition, the through-holes 29*a* to 29*d* similar to those described above are formed in the outer peripheral iron core portions 24 to 27, respectively. The number of the iron cores 41 to 44 and the number of the outer peripheral iron core portions 24 to 27 may not be necessarily equal to each other. The same applies to the core main body 5 illustrated in FIG. 2.

In addition, each of the iron cores 41 to 44 has a radial inner end portion positioned near the center of the outer peripheral iron core 20. In FIG. 6, the radial inner end portion of each of the iron cores 41 to 44 converges toward the center of the outer peripheral iron core 20 and has a tip angle of about 90 degrees. The radial inner end portions of the iron cores 41 to 44 are spaced apart from each other with the gaps 101 to 104 being magnetically couplable.

Single-dot-dash lines illustrated in FIG. 6 correspond to the intermediate plate 81 and the opening 89 thereof in the second embodiment. As illustrated in FIG. 6, when the outer peripheral iron core 20 is a substantially octagonal shape, the four protruding sections 91 protrude corresponding to four side of the substantially octagonal shape. It will be apparent that even with such a configuration, the reactor 6 is lifted up by passing the umbilical member L through the openings 91*a* of the two adjacent protruding sections 91, and thus similar effects as those described above can be obtained. Also, as illustrated in FIG. 6, the intermediate plate 81 may be configured with the plurality of intermediate plate portions 84 to 87 corresponding to the plurality of outer peripheral iron core portions 24 to 27. In this case, each of the intermediate plate portions 84 to 87 preferably has the openings 91*a* as the engaging sections.

Aspects of the Disclosure

According to a first aspect, there is provided a core main body (5) including an outer peripheral iron core (20) and at least three iron cores (41 to 44) disposed inside the outer peripheral iron core, wherein a radial inner end portion of each of the at least three iron cores converges toward a center of the outer peripheral iron core, each of gaps (101 to 104) being magnetically couplable is formed between one iron core of the at least three iron cores and another iron core adjacent to the one iron core, the radial inner end portions of the at least three iron cores are spaced apart from each other through the gaps being magnetically couplable, the outer peripheral iron core is configured with at least a first outer peripheral iron core block (20A) formed by stacking a plurality of magnetic plates, a second outer peripheral iron core block (20B) formed by stacking a plurality of magnetic plates, and an intermediate plate (81) disposed between the first outer peripheral iron core block and the second outer peripheral iron core block, and the intermediate plate includes an outer peripheral iron core corresponding portion (82) corresponding to the outer peripheral iron core, a plurality of protruding sections (91) protruding from an outer peripheral surface of the outer peripheral iron core, and engaging sections (91*a*) provided on the plurality of protruding sections.

According to a second aspect, in the first aspect, the first outer peripheral iron core block and the second outer peripheral iron core block are configured with a plurality of outer peripheral iron core portion blocks (20A1 to 20A3, 20B1 to 20B3), and the intermediate plate is configured with a plurality of intermediate plate portions (84 to 87) corresponding to the respective plurality of first outer peripheral iron core portion blocks.

According to a third aspect, in the first aspect, the intermediate plate further includes iron core corresponding portions (83) corresponding to the at least three iron cores.

According to a fourth aspect, there is provided a reactor (6) including the core main body of any one of the first to third aspects, coils (51 to 54) mounted on the respective at least three iron cores, and a pedestal (60) attached to one end of the core main body.

According to a fifth aspect, in the fourth aspect, a position of the engaging section in an axial direction of the reactor is approximately equal to a position of a center of gravity of the reactor.

According to a sixth aspect, in the fourth aspect or the fifth aspect, the number of the at least three iron core coils is a multiple of three.

According to a seventh aspect, in the fourth aspect or the fifth aspect, the number of the at least three iron core coils is an even number being equal to or more than four.

According to an eighth aspect, a method of manufacturing the reactor (6) including steps of stacking a plurality of magnetic plates and forming a plurality of first outer peripheral iron core portion blocks (20A1 to 20A3), stacking a plurality of magnetic plates and forming a plurality of second outer peripheral iron core portion blocks (20B1 to 20B3), preparing a plurality of intermediate plate portions (84 to 86) corresponding to the respective plurality of first outer peripheral iron core portion blocks, disposing each of the plurality of intermediate plate portions on each of the plurality of first outer peripheral iron core portion blocks, disposing each of the plurality of first outer peripheral iron core portion blocks on each of the plurality of intermediate plate portions and forming a plurality of outer peripheral iron core portions including at least three iron cores (41 to 43), mounting coils (51 to 53) on the respective at least three iron cores, assembling the plurality of outer peripheral iron core portions together and forming a core main body (5), and attaching a pedestal (60) to one end of the core main body and securing the core main body and the pedestal to each other.

Effects of Aspects

In the first aspect and the eighth aspect, since the intermediate plate is disposed between the first outer peripheral iron core block and the second outer peripheral iron core block, the engaging segments of the intermediate plate are adjacent to the center of gravity of the core main body. Thus, when the engaging section is lifted up by using the core main body, the core main body is hardly inclined. Therefore, lowering workability is suppressed during transport and attachment.

In the second aspect, the large outer peripheral iron core 20 can be easily manufactured without lowering workability during transport and attachment.

In the third aspect, generation of noise due to vibration of the iron core can be suppressed when the reactor provided with the core main body is driven.

In the fourth aspect, lowering workability can be suppressed during transport and attachment of the reactor.

In the fifth aspect, lowering workability can be further suppressed during transport and attachment of the reactor.

In the sixth aspect, the reactor can be used as a three-phase reactor.

In the seventh aspect, the reactor can be used as a single-phase reactor.

While the invention has been described with reference to specific embodiments, it will be understood, by those skilled in the art, that various changes or modifications may be made thereto without departing from the scope of the claims described later.

The invention claimed is:

1. A core main body comprising:

an outer peripheral iron core;

at least three iron cores disposed inside the outer peripheral iron core; and a coil mounted on each of the at least three iron cores, wherein a radial inner end portion of each of the at least three iron cores converges toward a center of the outer periphery iron core, a gap being magnetically couplable is formed between one iron core of the at least three iron cores and another iron core adjacent to the one iron core, and the radial inner end portions of the at least three iron cores are spaced apart from each other through the gap being magnetically couplable, the outer peripheral iron core is configured with at least a first outer peripheral iron core block formed by stacking a plurality of magnetic plates, a second outer peripheral iron core block formed by stacking a plurality of magnetic plates, and an intermediate plate disposed between the first outer peripheral iron core block and the second outer peripheral iron core block, and the intermediate plate includes an outer peripheral iron core corresponding portion corresponding to the outer peripheral iron core, a plurality of protruding sections protruding from an outer peripheral surface of the outer peripheral iron core, and engaging sections provided on the plurality of protruding sections, wherein a position of the engaging sections in an axial direction of the core main body is approximately equal to a position of a center of gravity of the core main body.

2. The core main body of claim 1, wherein the first outer peripheral iron core block and the second outer peripheral iron core block are configured with a plurality of outer peripheral iron core portion blocks and the intermediate plate is configured with a plurality of intermediate plate portions corresponding to the respective plurality of first outer peripheral iron core portion blocks.

3. The core main body of claim 1, wherein the intermediate plate further includes iron core corresponding portions corresponding to the at least three iron cores.

4. A reactor comprising:

the core main body according to claim 1; and a pedestal attached to one end of the core main body.

5. The reactor of claim 4, wherein the number of the at least three iron core coils is a multiple of three.

6. The reactor of claim 4, wherein the number of the at least three iron core coils is an even number being equal to or more than four.

7. A method of manufacturing a reactor comprising steps of:

stacking a plurality of magnetic plates and forming a plurality of first outer peripheral iron core portion blocks;

stacking a plurality of magnetic plates and forming a plurality of second outer peripheral iron core portion blocks;

preparing a plurality of intermediate plate portions corresponding to the respective plurality of first outer peripheral iron core portion blocks;

disposing each of the plurality of intermediate plate portions on each of the plurality of first outer peripheral iron core portion blocks;

disposing each of the plurality of first outer peripheral iron core portion blocks on each of the plurality of intermediate plate portions and forming a plurality of outer peripheral iron core portions including at least three iron cores, wherein a position of engaging sections of the plurality of intermediate plate portions in an axial direction of the reactor is approximately equal to a position of a center of gravity of the reactor;

mounting a coil on each of the at least three iron cores;

assembling the plurality of outer peripheral iron core portions together and forming a core main body; and attaching a pedestal to one end of the core main body and securing the core main body and the pedestal to each other.

* * * * *